US007119779B2

(12) United States Patent
Huang

(10) Patent No.: US 7,119,779 B2
(45) Date of Patent: Oct. 10, 2006

(54) DISPLAY DEVICE REFRESH

(75) Inventor: Samson X. Huang, Saratoga, CA (US)

(73) Assignee: Intel Corporation, Santa Clara, CA (US)

( * ) Notice: Subject to any disclaimer, the term of this patent is extended or adjusted under 35 U.S.C. 154(b) by 413 days.

(21) Appl. No.: 10/396,579

(22) Filed: Mar. 25, 2003

(65) Prior Publication Data

US 2004/0189622 A1 Sep. 30, 2004

(51) Int. Cl.
*G09G 3/36* (2006.01)

(52) U.S. Cl. ..... 345/96; 345/3.2; 345/53; 345/54; 345/94; 345/208; 345/95; 345/209

(58) Field of Classification Search ..... 345/52, 345/53, 92, 204, 209, 210, 3.2, 54, 79, 94–96, 345/208

See application file for complete search history.

(56) References Cited

U.S. PATENT DOCUMENTS 5,526,012 A * 6/1996 Shibahara ..... 345/92
5,784,042 A * 7/1998 Ono et al. ..... 345/94
6,304,239 B1 * 10/2001 McKnight ..... 345/87
2003/0048424 A1 * 3/2003 Schaareman et al. ..... 353/31
2003/0227448 A1 * 12/2003 Janssen et al. ..... 345/204
2003/0231160 A1 * 12/2003 Yoshihara et al. ..... 345/102

* cited by examiner

*Primary Examiner*—Richard Hjerpe
*Assistant Examiner*—Jennifer T. Nguyen
(74) *Attorney, Agent, or Firm*—Buckley, Maschoff & Talwalkar LLC

(57) ABSTRACT

Some embodiments provide application, at a beginning of a first display frame, of a first potential to a pixel imaging element, the first potential to reset the pixel imaging element to a reset state, application, during the first display frame, of a second potential to the pixel imaging element, the second potential to set the pixel imaging element to a desired imaging state, and change, at a beginning of a second display frame subsequent to the first display frame, of the second potential to a third potential, the third potential to reset the pixel imaging element to the reset state.

10 Claims, 6 Drawing Sheets

DISPLAY DEVICE REFRESH

BACKGROUND

Some display devices include a two-dimensional array of pixel cells formed on a substrate. Each pixel cell may be adapted to apply a voltage to a corresponding pixel imaging element such as a portion of liquid crystal material. The voltage may establish an electric field across the pixel imaging element, and the pixel imaging element may produce an image pixel of a desired pixel intensity for a given image frame.

Conventional display devices reduce an intensity of the electric field prior to a subsequent image frame. The reduced intensity may be intended to reset a state of the pixel imaging element prior to the subsequent image frame. After the state is reset, a voltage is applied to the pixel imaging element during the subsequent image frame in order to produce another image pixel of desired intensity.

DETAILED DESCRIPTION

Figure 1:
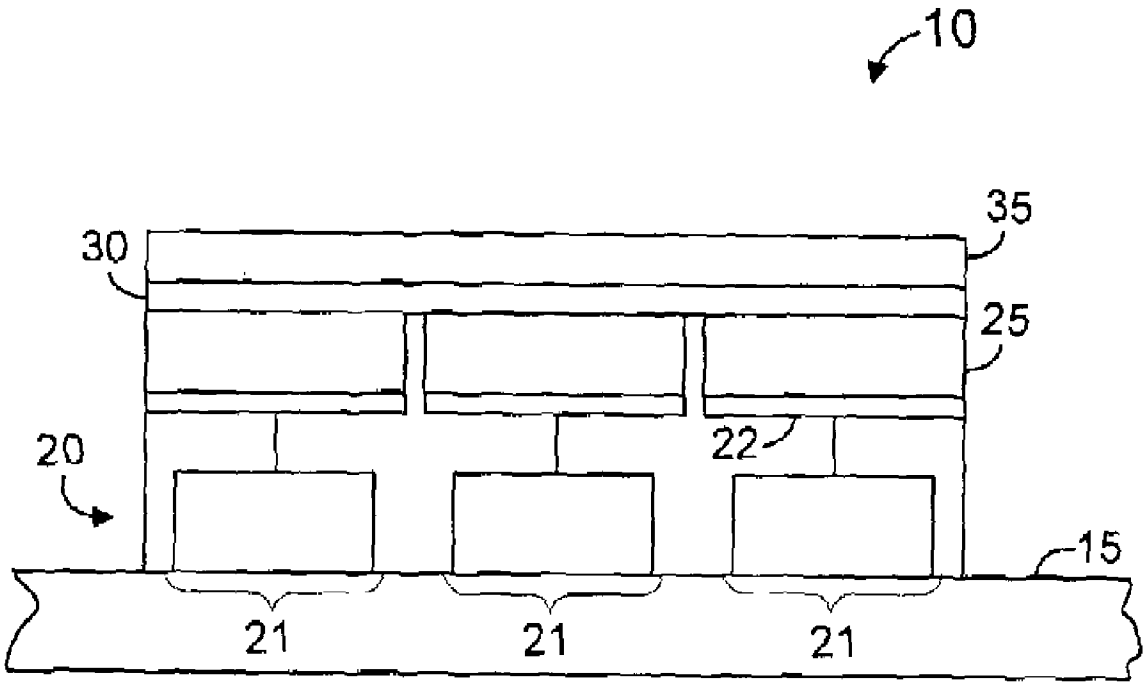
FIG. 1 is a schematic side cross-sectional view of a display device according to some embodiments.

FIG. 1 is a schematic side cross-sectional view of a portion of display device 10 according to some embodiments. Display device 10 of FIG. 1 is a Liquid Crystal on Silicon (LCoS) device, but embodiments are not limited thereto. Rather, embodiments may be implemented with Liquid Crystal Diode (LCD) devices, Digital Micromirror Display (DMD) devices, or display devices using any other suitable display technology.

Display device 10 of FIG. 1 includes substrate 15 on which pixel cell array 20 is formed. Substrate 15 may comprise single-crystal silicon or any other substrate on which circuit elements may be fabricated. In this regard, pixel cell array 20 may be formed on substrate 15 through currently-or here after-known masking, etching, and deposition techniques.

FIG. 1 shows three pixel cells 21 within pixel cell array 20. Pixel cells 21 may be arranged in a two-dimensional grid of equally-spaced pixel cells. In some embodiments the two-dimensional grid may include hundreds of pixel cells 21 on a side. Each pixel cell 21 of the grid may correspond to a single image pixel of display device 10.

Each pixel cell 21 includes an associated pixel electrode 22. Pixel electrode 22 may comprise a reflective material such as aluminum for reflecting light incident thereto. One pixel electrode 22 may be used to apply a voltage signal, or potential, to one of pixel imaging elements 25 with which it is in contact. In this regard, pixel imaging elements 25 may comprise a layer of liquid crystal of any suitable type. Pixel imaging elements 25 may also comprise a layer of micromirrors. In either case, the layer may be segmented into a grid of individual pixel imaging elements 25, with each pixel imaging element 25 corresponding to one of pixel cells 21. Each pixel imaging element 25 may therefore also correspond to a single image pixel of display device 10.

Electrode 30 may contact each of pixel imaging elements 25. In some embodiments, electrode 30 comprises Indium Tin Oxide. Electrode 30 is disposed between pixel imaging elements 25 and glass 35. Glass 35 may be coated with an anti-reflective material to increase a percentage of incident light that passes through glass 35 and on to pixel imaging elements 25.

In operation, a pixel cell 21 of pixel cell array 20 applies a voltage to a corresponding pixel imaging element 25. The voltage is applied by a pixel electrode 22 of the pixel cell 21. The applied voltage may create an electric field across the pixel imaging element 25 in conjunction with a voltage signal applied to electrode 30. More specifically, a strength of the electric field is based on a potential difference between the applied potential and a potential of electrode 30. The pixel imaging element 25 reacts to the electric field according to its characteristic behavior.

In this regard, the pixel imaging element 25 may operate as an electrically-activated light filter. When subjected to a weak on no electric field, the pixel imaging element 25, in some embodiments, prevents light that is received through glass 35 from passing to the reflective surface of the pixel electrode 22. When subjected to a stronger electric field, the pixel imaging element 25 may allow light received through glass 35 to pass to the reflective surface of the pixel electrode 22. A percentage of light that passes to pixel electrode 22 may increase as the strength of the electric field increases. As described below, some embodiments of pixel imaging elements 25 operate substantially based on an absolute magnitude of the electric field rather than based on a polarity and a magnitude of the electric field.

According to some embodiments, pixel imaging elements 25 allow light to pass therethrough when subjected to weak or negligible electric fields and prevent light from passing when subjected to stronger electric fields. Some embodiments of pixel imaging elements 25 direct light received through glass 35 using other techniques.

Returning to the operational example, the voltage applied to the pixel imaging element 25 is determined by external circuitry (not shown) that specifies a desired intensity of an image pixel that is associated with the pixel imaging element 25. Accordingly, to form an image using display device 10, a desired intensity is determined for each pixel of the image. Voltages that correspond to the desired image pixel intensities are then applied to pixel imaging elements 25 that correspond to the image pixels. As a result, any light incident to glass 35 will reflect off of pixel electrodes 22 and exit from glass 35 toward an observer in accordance with the desired intensities. A display device 10 may display a moving image by rapidly displaying successive images. In such a case, the successive images may be referred to as image frames.

Figure 2:
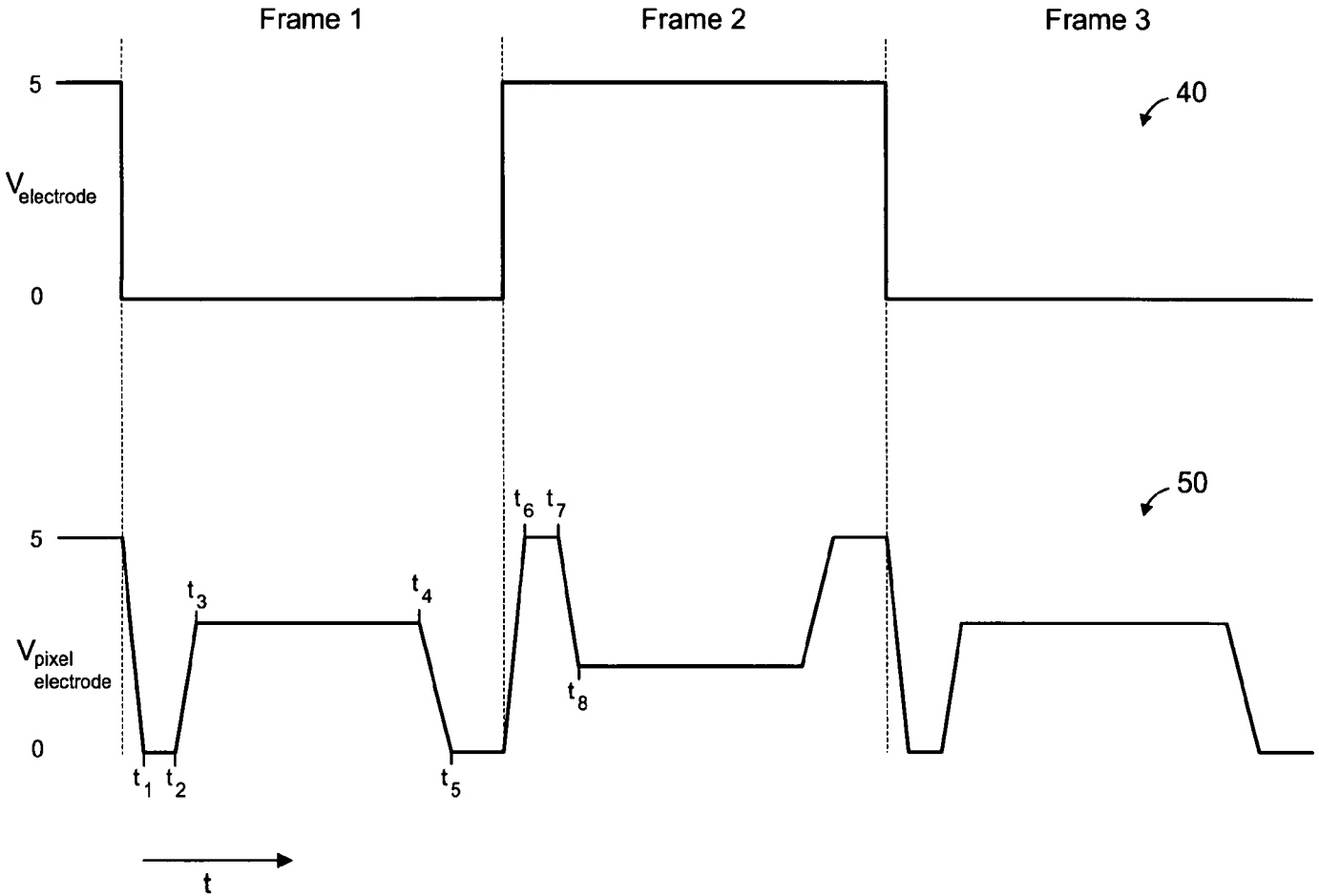
FIG. 2 PRIOR ART
FIG. 2 is a waveform diagram illustrating conventional display device voltages.

FIG. 2 is a waveform diagram illustrating voltages during conventional operation of display device 10. Waveform 40 shows voltages of electrode 30 during three successive image frames. Waveform 50 illustrates voltages of one pixel electrode 22 during the same three image frames. Accordingly, waveform 50 illustrates various potentials that are applied to a pixel imaging element 25 that is in contact with the one pixel electrode 22. The one pixel electrode 22 and the associated pixel imaging element 25 correspond to a single image pixel of display device 10. In the present example, the single image pixel is intended to be "on" during each of the three image frames.

An image pixel will be considered "on" herein if light incident to its associated pixel imaging element is allowed to reflect off an associated pixel electrode so to produce a maximum intensity image pixel. This configuration may correspond to a white image pixel. This convention is arbitrary, as such an image pixel may also be considred "off" and/or "black" in some embodiments.

Prior to Frame 1, both electrode 30 and pixel electrode 22 are set to +5V. Display device 10 of the present example is DC-balanced, therefore the potential of electrode 30 alternates between 0 and +5V in successive frames. Accordingly, the potential of electrode 30 drops to 0V at a beginning of Frame 1. The potential of pixel electrode 22 also drops to 0V at the beginning of Frame 1, but the drop is more gradual than the drop experienced by electrode 30. The gradual drop experienced by pixel electrode 30 reflects the gradual discharging of a capacitive circuit that controls the potential of pixel electrode 22. One example of such a circuit will be described below.

The potential of pixel electrode 22 is set to 0V in order to reset the associated pixel imaging element 25 to a reset state. More specifically, an electric field across the pixel imaging element 25 becomes negligible in a case that the potential of pixel electrode 22 is set equal to a potential of electrode 30. The potential of pixel electrode 22 is then held at 0V from $t_1$ to $t_2$ in order to allow time for the pixel imaging element 25 to enter the reset state. According to the implementation reflected in FIG. 2, the reset state is a state in which pixel imaging element 25 is subjected to a negligible electric field and blocks incident light from reaching pixel electrode 22.

Pixel electrode 22 is set to +3V at time $t_2$ and reaches +3V at time $t_3$. The capacitive circuit that controls the potential of pixel electrode 22 is charged to +3V during the interval between time $t_2$ and time $t_3$.

The potential difference between electrode 30 and pixel electrode 22 is equal to 3V at time $t_3$. According to the present example, the pixel imaging element 25 is designed to allow maximum light therethrough if a potential difference between pixel electrode 22 and electrode 30 is at least 3V, regardless of polarity. Therefore, at time $t_3$, any light incident to the pixel imaging element 25 passes to and is reflected off of pixel electrode 22.

Pixel electrode 22 is set to 0V at time $t_4$ and reaches 0V at time $t_5$ in order to reset the pixel imaging element 25 to the reset state prior to the end of Frame 1. Pixel electrode 22 is held at 0V from time $t_5$ until the beginning of Frame 2 to allow time for the pixel imaging element 25 to enter the reset state.

As described above, the potential of electrode 30 is set to +5V at the beginning of Frame 2. The potential of pixel electrode 22 is also set to +5V at the beginning of Frame 2, and reaches +5V at time $t_6$. The pixel imaging element 25 is therefore reset to the reset state by time $t_7$.

Pixel electrode 22 is set to +2V at time $t_7$ and reaches +2V at time $t_8$. The potential difference between electrode 30 and pixel electrode 22 is therefore equal to 3V at time $t_8$. Consequently, the pixel imaging element 25 allows a maximum amount of light therethrough at time $t_8$. The pixel imaging element 25 is reset at the end of Frame 2 by setting pixel electrode 22 back to +5V, and Frame 3 progresses as described above with respect to Frame 1.

Figure 3:
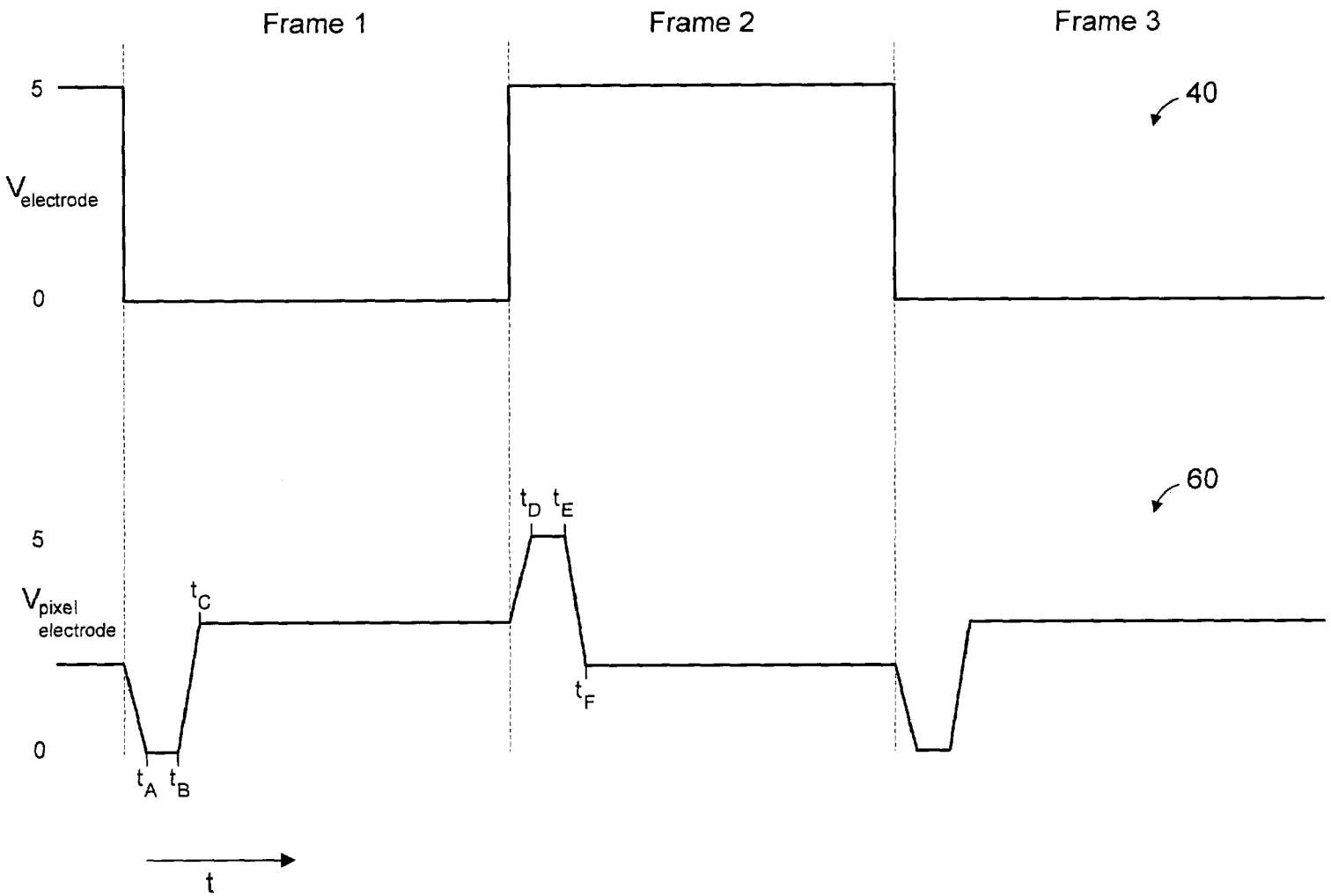
FIG. 3 is a waveform diagram illustrating display device voltages according to some embodiments.

In contrast to FIG. 2, FIG. 3 is a waveform diagram illustrating display device voltages according to some embodiments. As shown, pixel electrodes are selectively discharged or charged at the end of each frame depending upon a pixel electrode voltage desired at the beginning of a next frame. Such a process may reduce power required by display device 10 in comparison to the process illustrated in FIG. 2.

Waveform 40 of FIG. 3 is as illustrated in FIG. 2, alternating between +5V and 0V during successive Frames 1, 2 and 3. Waveform 60 depicts a voltage of one pixel electrode 22 during the same three image frames according to some embodiments. Waveform 60 therefore illustrates various potentials that are applied to a pixel imaging element 25 that is in contact with the one pixel electrode 22. The one pixel electrode 22 and the associated pixel imaging element 25 correspond to a single image pixel of display device 10, and the single image pixel is intended to be "on" during each of the three image frames.

Electrode 30 is set to +5V and pixel electrode 22 is set to +2V prior to Frame 1. Pixel electrode 22 is set to 0V at the beginning of Frame 1 and reaches 0V at time $t_A$. A 0V potential is therefore applied to the pixel imaging element 25 by pixel electrode 22 from time $t_A$ to time $t_B$. Since electrode 30 is also at 0V, a potential difference between electrode 30 and pixel electrode 22 during this time is negligible. An electric field across the pixel imaging element 25 is also negligible. As a result, the pixel imaging element 25 is reset to a reset state at time $t_B$.

In some embodiments, the reset state is a state in which the pixel imaging element 25 does not allow light to pass therethrough, while in some embodiments the reset state is a state in which the pixel imaging element 25 allows maximum light to pass therethrough. According to the present example, the reset state is a state in which the pixel imaging element 25 does not allow light to pass therethrough. A reset state is achieved in some embodiments by subjecting the pixel imaging element 25 to an electric field having a particular magnitude, while other imaging states are achieved by subjecting the pixel imaging element 25 to electric fields of lesser magnitude.

The desired intensity of the subject pixel during Frame 1 is a maximum intensity. Moreover, the pixel imaging element 25 of the present example is designed to pass a maximum amount of light when a potential difference between pixel electrode 22 and electrode 30 is at least 3V. Accordingly, the potential difference associated with the desired image pixel intensity is 3V.

Pixel electrode 22 is therefore set to +3V at time $t_B$ and reaches +3V at time $t_C$. The resulting potential difference between electrode 30 and pixel electrode 22 is equal to 3V at time $t_C$. This potential difference sets the pixel imaging element 25 to the desired imaging state in which all light incident to the pixel imaging element 25 passes to and is reflected off of pixel electrode 22.

The potentials of electrode 30 and pixel electrode 22 are held at 0V and +3V, respectively, until the beginning of Frame 2. At the beginning of Frame 2, electrode 30 and pixel electrode 22 are both set to +5V. The potential of pixel electrode 22 changes from +3V to +5V at time $t_D$ and the pixel imaging element 25 resets to the reset state by time $t_E$, wherein a potential difference between electrode 30 and pixel electrode 22 is substantially zero at time $t_E$. Pixel electrode 22 retains the charge it held during most of Frame 1 and its potential is increased by only +2V at the beginning of Frame 2. In contrast, waveform 50 shows a loss of all the charge held by pixel electrode 22 during most of Frame 1 and an increase in the potential of pixel electrode 22 of +5V at the beginning of Frame 2.

At time $t_E$, pixel electrode 22 is set to +2V. Pixel electrode 22 then reaches +2V at time $t_F$, thereby establishing a 3V potential difference between pixel electrode 30 and pixel electrode 22. Although this potential difference is opposite in polarity to the potential difference experienced by the pixel imaging element 25 at time $t_C$, the pixel imaging element 25 is set to the desired imaging state at time $t_F$. Again, the desired imaging state in this example is a state in which a maximum amount of light incident to the pixel imaging element 25 passes to and is reflected off of pixel electrode 22. Frame 3 then proceeds as described above with respect to Frame 1.

Figure 4:
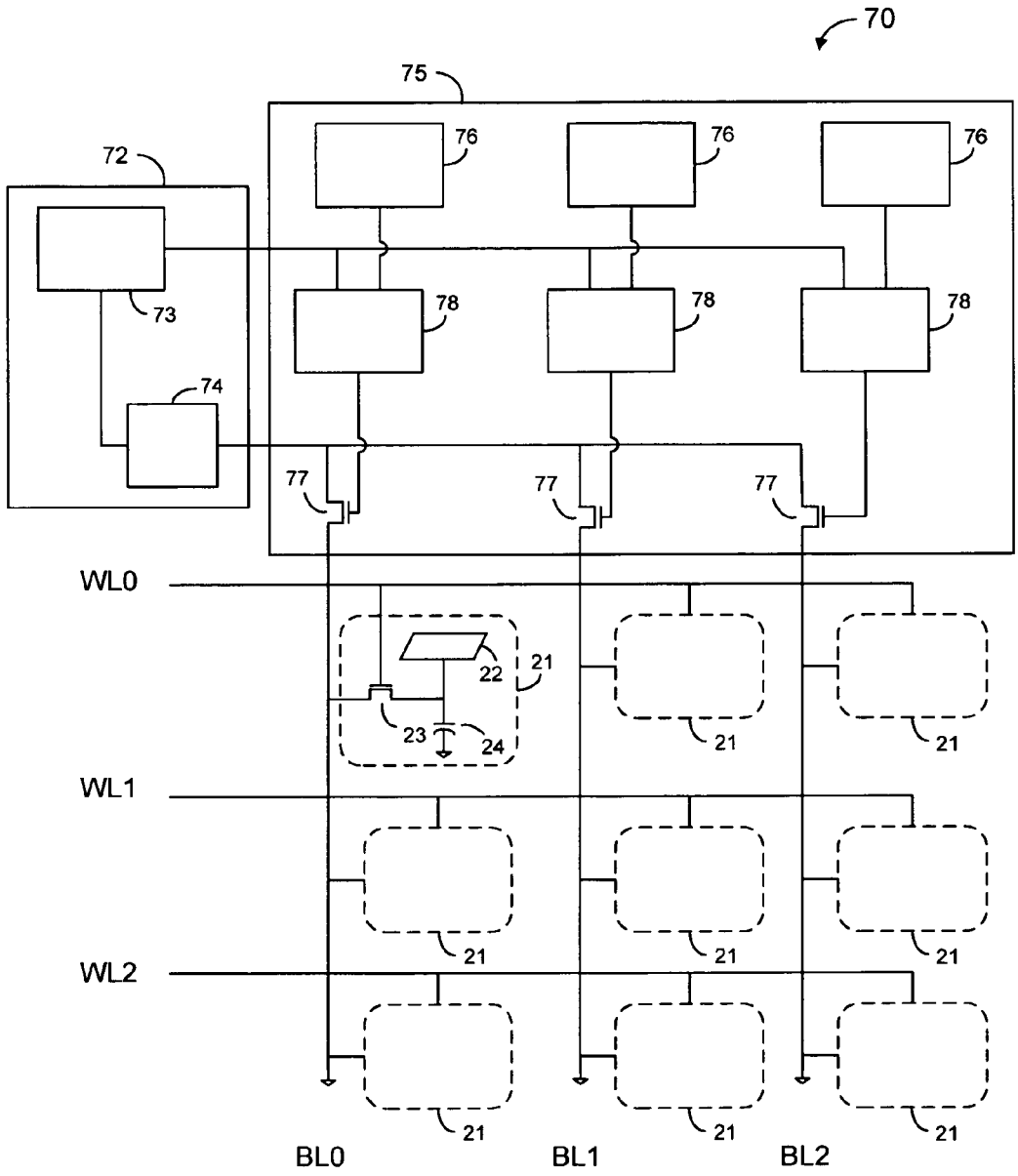
FIG. 4 is a diagram of a circuit according to some embodiments.

FIG. 4 is a circuit diagram according to some embodiments. Circuit 70 may be used to generate waveform 60. In a specific example, circuit 70 may apply, at a beginning of a first display frame, a first potential to a pixel imaging element, the first potential to reset the pixel imaging element to a reset state, and may apply, during the first display frame, a second potential to the pixel imaging element, the second potential to set the pixel imaging element to a desired imaging state. Circuit 70 may also change, at a beginning of a second display frame subsequent to the first display frame, the second potential to a third potential, the third potential to reset the pixel imaging element to the reset state.

Circuit 70 includes some elements of display device 10 of FIG. 1, such as several pixel cells 21 arranged in an equally-spaced two-dimensional grid. Although a 3×3 grid is shown, embodiments may include any number of pixel cells 21 arranged in any fashion. Each pixel cell 21 may apply a voltage to a pixel imaging element 25 that is associated with a particular image pixel. Each pixel cell 21 includes a pixel electrode 22 as described above, and also includes a transfer gate 23 such as an n-channel Complementary Metal Oxide Semiconductor (CMOS) transistor. Transfer gate 23 operates to charge or discharge capacitor 24 to a particular voltage in accordance with voltage signals received from an associated bit-line (BL#) and an associated word-line (WL#).

A gate terminal of transfer gate 23 may receive a voltage signal from an associated word-line and, in response, allow current to flow between capacitor 24 and an associated bit-line. Capacitor 24 then discharges or charges to match the voltage of a voltage signal on the associated bit-line. Pixel electrode 22 is coupled to capacitor 24 such that a voltage of pixel electrode 22 is controlled by the voltage of capacitor 24. Since a pixel imaging element 25 is in contact with pixel electrode 22, the voltage of capacitor 24 determines a voltage that is applied to the pixel imaging element 25.

Ramp circuit 72 produces a ramp voltage signal according to some embodiments. Ramp circuit 72 includes digital counter 73 and digital-to-analog converter 74. Digital counter 73 may output an incrementally changing digital code, such as an 8-bit digital code that changes in value from 0 to 255 in 255 one-bit increments. Converter 74 receives the incrementally changing digital code and converts the code to a ramp voltage signal. For example, a digital code of 0 may be converted to a 0V voltage signal, a digital code of 255 may be converted to a +5V voltage signal, and any intermediate digital code may be converted to a voltage signal of an intermediate voltage between 0V and +5V.

Data circuit 75 may transmit the ramp voltage signal from ramp circuit 72 to a pixel cell 21 in a case that a voltage of the ramp voltage signal corresponds to a desired intensity of an image pixel that is associated with the pixel cell 21. Data circuit 75 includes pixel data buffers 76, transfer gates 77, and comparators 78. Each pixel data buffer 76 receives 8-bit digital pixel data that specifies the desired intensity of an image pixel. For example, the pixel data 00000000 may indicate a low-intensity (black) pixel while the pixel data 11111111 may indicate a high-intensity (white) pixel.

Each transfer gate 77 may comprise an n-channel CMOS transistor coupled to the output of ramp circuit 72 and to a column of pixel cells 21 via an associated bit-line. Each transfer gate 77 may transmit the ramp voltage signal from ramp circuit 72 to the column of pixel cells 21 in response to a control signal. The control signal may be received from an associated one of comparators 78.

Each comparator 78 is coupled to digital counter 73 and to an associated pixel data buffer 76 and transfer gate 77. In operation, a comparator 78 may compare the digital code received from digital counter 73 to pixel data received from the associated pixel data buffer 76. In a case that the digital code is equal to the pixel data, the comparator 78 may output the control signal to the associated transfer gate 77. As a result, a column of pixel cells 21 associated with the transfer gate 77 receives an analog voltage signal having a voltage that corresponds to the pixel data.

In a more detailed example according to some embodiments, pixel data for a first row of pixel cells 21 is stored in pixel data buffers 76. The pixel data stored in a particular pixel data buffer 76 specifies a desired intensity of an image pixel that is located in the first row and in a column corresponding to the particular pixel data buffer 76. Comparators 78 do not receive a signal from digital counter 73. Accordingly, each comparator 78 outputs a low signal that "opens" its associated transfer gate 77.

At the beginning of a first frame, the pixel imaging elements 25 of the first row are reset using conventional techniques. According to some conventional techniques, transfer gates 23 in the first row of pixel cells 21 are "opened" by transmitting a low signal on word-line WL0. A reset signal is then applied to a reset signal line (not shown) that is coupled to the pixel electrode 22 of each pixel cell 21. The reset signal causes the pixel electrode 22 to apply a voltage to its associated pixel imaging element 25.

In the present example, the applied voltage is substantially equal to a voltage of electrode 30. As a result, the associated pixel imaging element 25 is subjected to a negligible electric field and is reset to a reset state. Next, a high signal is transmitted on word-line WL0 in order to "close" each transfer gate 23 in the first row of pixel cells 21.

Digital counter 73 begins outputting a digital code that incrementally changes from 0 to 255. As described above, converter 74 receives the digital code and outputs an analog ramp voltage signal having a voltage that corresponds to the received digital code. Each comparator 78 also receives the digital code and outputs a high signal when the digital code is equal to the pixel data stored in a corresponding pixel data buffer 76. The output signal "closes" an associated transfer gate 77, which in turn transmits a ramp voltage signal to a pixel cell 21 that is coupled to the transfer gate.

The ramp voltage signal represents a voltage that corresponds to the pixel data. The ramp voltage signal is therefore associated with a desired intensity of an image pixel that corresponds to the pixel cell 21. The transfer gate 23 of the pixel cell 21 couples the ramp voltage signal to the capacitor of the pixel cell 21, which charges or discharges to the voltage of the ramp voltage signal. Consequently, the voltage of the ramp voltage signal is applied to pixel electrode 22 of the pixel cell 21 and to a pixel imaging element 25 that is associated with the pixel cell 21. The voltage of the ramp voltage signal thereby sets the pixel imaging element 25 to an imaging state corresponding to the desired intensity of the associated image pixel.

Accordingly, a ramp voltage signal representing a desired image pixel intensity is transmitted to each pixel cell 21 of the first row. The above process is repeated for each row of pixel cells 21. More particularly, pixel data for a next row are stored in pixel data buffers 76, transfer gates 23 of the row are opened by transmitting a high signal on a word-line corresponding to the row, and digital counter 73 is controlled to begin outputting an incrementally changing digital code to converter 74 and to comparators 78.

The above process repeats for each subsequent display frame. At the beginning of each display frame, the voltages currently applied to each pixel imaging element 25 are changed to a voltage that is intended to reset the pixel imaging elements 25 to the reset state. This voltage is +5V according to Frame 2 of the FIG. 3 example, but may be any other suitable voltage. The voltage may be changed using the above-mentioned conventional resetting techniques.

Figure 5:
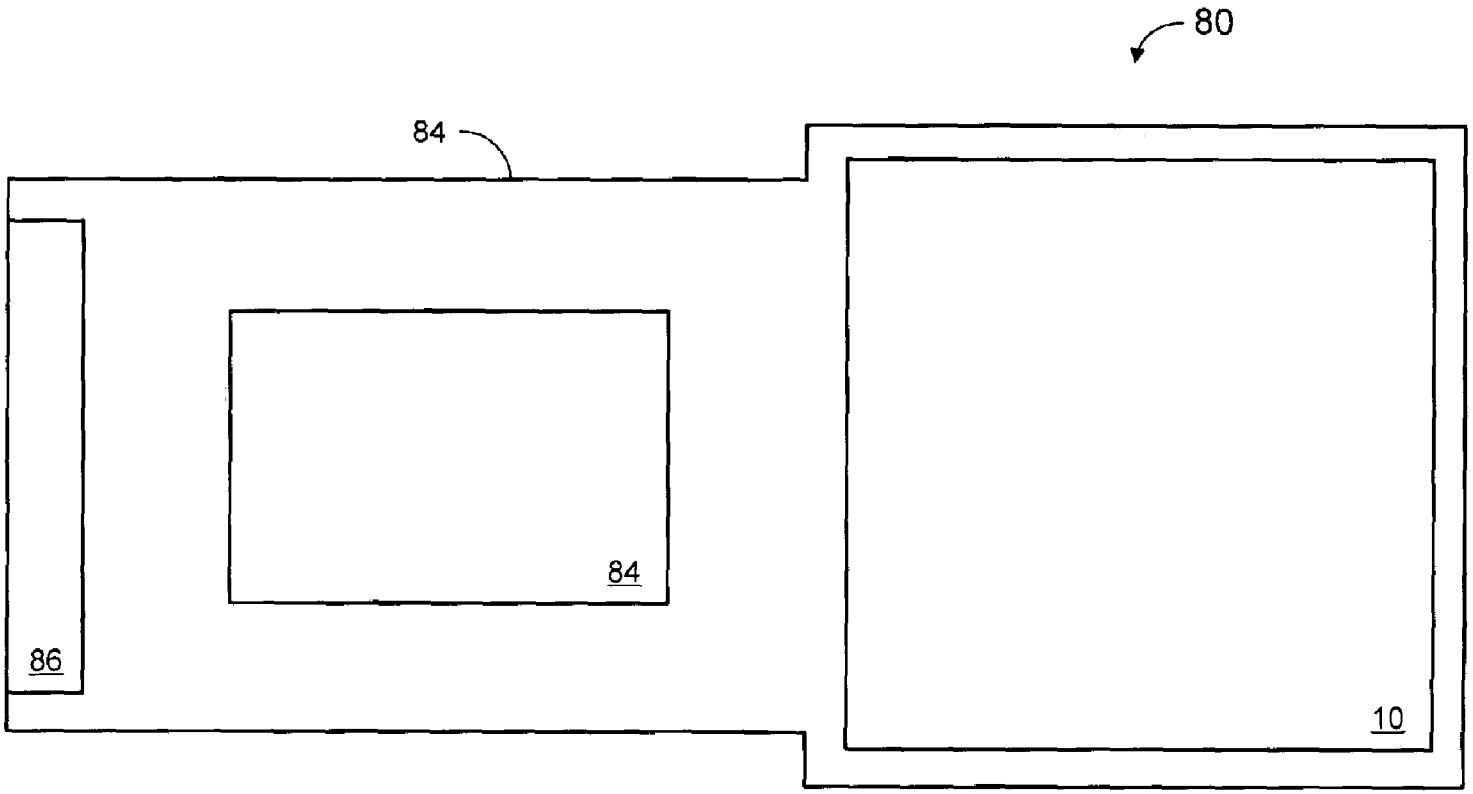
FIG. 5 is a block diagram of a display panel according to some embodiments.

FIG. 5 is a block diagram of a display panel according to some embodiments. Display panel 80 comprises display device 10, circuit board 82, control circuitry 84, and communication interface 86. Display panel 80 may be used alone or in conjunction with other display panels in a display system according to some embodiments.

Display device 10 is mounted to circuit board 82 using currently-or hereafter-known techniques. Display device 10 may comprise a silicon chip with devices and materials formed thereon, and therefore may be mounted to circuit board 82 using techniques for mounting a silicon chip to a circuit board.

Control circuitry 84 may include one or both of ramp circuit 72 and data circuit 75. Control circuitry 84 may also include driving elements for resetting pixel imaging elements 25 of display device 10. Moreover, control circuitry 84 may include elements for driving the bit-lines and word-lines of display device 10 to operate according to some embodiments.

Pixel data may be received from an external source by communication interface 86. Communication interface 86 may also be used to receive and transmit signals used to synchronize the operation of display device 10 with other elements of a display system.

Figure 6:
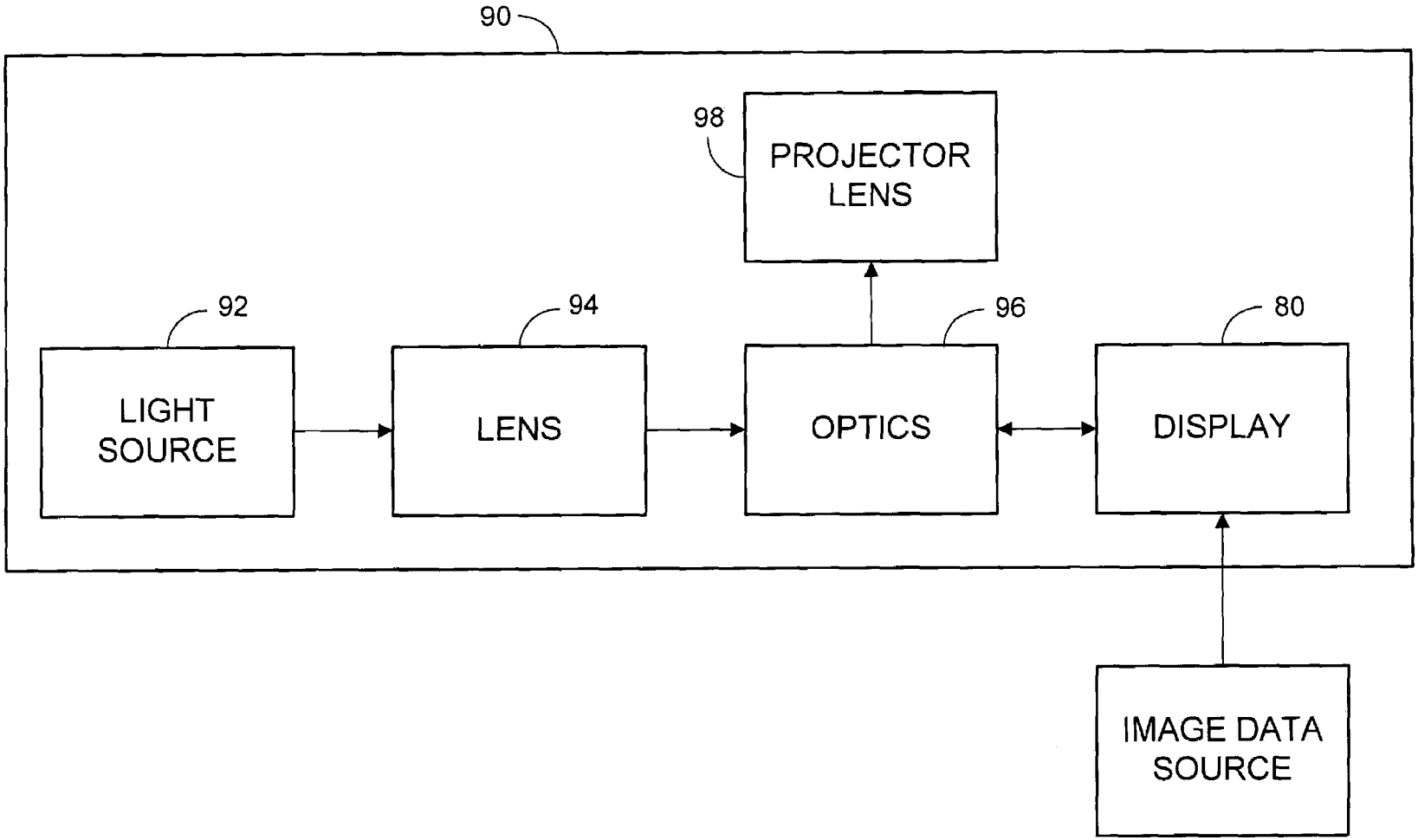
FIG. 6 is a block diagram of a display system according to some embodiments.

FIG. 6 is a block diagram of a display system according to some embodiments. Display system 90 may be used to project a color image using one or more display panel(s) 80. Display system 90 comprises light source 92, lens 94, optics 96, and projector lens 98. Image data source 100 may comprise any device such as a personal computer, a television tuner, a personal digital assistant, and a digital video disc player. Image data source 100 provides display panel(s) 80 with image data for display.

Light source 92 provides light to display 90. Light source 92 may comprise a 100W–500W lamp such as a metal halide lamp or an Ultra High Pressure (UHP) arc lamp. The light is received by lens 94, which transmits a uniform beam of light to optics 96. Optics 96 may include a dichroic filter for removing non-visible light from the beam of light. Optics 96 may also include one or more mirrors, color filters, and prisms for directing selected spectral bands of light to display panel(s) 80.

Generally, optics 96 may project separate spectral bands of light (e.g., red, green, or blue light) to display panel(s) 80. In some embodiments using three display panels 80, pixel imaging elements 25 of each display panel 80 are set to imaging states corresponding to pixel intensities a red, green, or blue component of an image. Optics 96 project a corresponding spectral band onto each display panel 80, receive reflected light that represents each of the three components of the image from the display panels 80, combine the reflected light into a single full-color image, and transmit the image to projector lens 98.

Projector lens 98 receives the transmitted image, which may measure less than an inch across. Projector lens 98 may magnify, focus, and project the image toward a projection screen (not shown). Display system 90 may be located on a same side of the projector screen as the intended audience (front projection), or the screen may be located between the audience and display system 90 (rear projection).

The several embodiments described herein are solely for the purpose of illustration. Embodiments may include any currently or hereafter-known versions of the elements described herein. Therefore, persons skilled in the art will recognize from this description that other embodiments may be practiced with various modifications and alterations.

What is claimed is:

1. A circuit to:

apply, at a beginning of a first display frame, a first potential to a common electrode associated with a plurality of pixel imaging elements, and to a pixel electrode associated with one of the plurality of pixel imaging elements;

apply, during the first display frame and while the first potential is applied to the common electrode, a second potential to the pixel electrode;

change, at a beginning of a second display frame subsequent to the first display frame, the first potential applied to the common electrode to a third potential;

change, at the beginning of the second display frame, the second potential applied to the pixel electrode to the third potential;

apply, during the second display frame and while the third potential is applied to the common electrode, a fourth potential to the pixel electrode;

change, at a beginning of a third display frame subsequent to the second display frame, the third potential applied to the common electrode to the first potential; and change, at the beginning of the third display frame, the fourth potential applied to the pixel electrode to the first potential.

2. A circuit according to claim 1, wherein a difference between the first potential and the second potential is associated with a desired image pixel intensity, and wherein a difference between the third potential and the fourth potential is associated with a desired image pixel intensity.

3. A circuit according to claim 1, wherein the one pixel imaging element is not reset to the reset state between the application of the second potential and the change of the second potential to the third potential.

4. A circuit according to claim 1, wherein a difference between the first potential and the second potential is associated with a desired image pixel intensity.

5. A circuit according to claim 1, the circuit to:

receive pixel data corresponding to a desired imaging state;

receive a value from a ramping device; and compare a value of the received pixel data with the value received from the ramping device, wherein the second potential is applied if the value of the received pixel data is equal to the value received from the ramping device.

6. A method comprising:

at a beginning of a first display frame, applying a first potential to a common electrode associated with a plurality of pixel imaging elements, and to a pixel electrode associated with one of the plurality of pixel imaging elements;

during the first display frame and while the first potential is applied to the common electrode, applying a second potential to the pixel electrode;

changing, at a beginning of a second display frame subsequent to the first display frame, the first potential applied to the common electrode to a third potential;

at the beginning of the second display frame, changing the second potential applied to the pixel electrode to the third potential;

during the second display frame and while the third potential is applied to the common electrode, applying a fourth potential to the pixel electrode;

changing, at a beginning of a third display frame subsequent to the second display frame, the third potential applied to the common electrode to the first potential; and at the beginning of the third display frame, changing the fourth potential applied to the pixel electrode to the first potential.

7. A method according to claim 6, wherein the one pixel imaging element is not reset to the reset state between the steps of applying the second potential and changing the second potential to the third potential.

8. A method according to claim 6, further comprising:

receiving pixel data corresponding to a desired imaging state;

receiving a value from a ramping device; and comparing a value of the received pixel data with the value received from the ramping device, wherein the second potential is applied if the value of the received pixel data is equal to the value received from the ramping device.

9. A system comprising:

an Ultra High Pressure light source to emit light;

a condenser lens to condense the light;

a display device to receive the condensed light and to emit image light, the display device comprising:

a circuit to:

apply, at a beginning of a first display frame, a first potential to a common electrode associated with a plurality of pixel imaging elements, and to a pixel electrode associated with one of the plurality of pixel imaging elements;

apply, during the first display frame and while the first potential is applied to the common electrode, a second potential to the pixel electrode;

change, at a beginning of a second display frame subsequent to the first display frame, the first potential applied to the common electrode to a third potential;

change, at the beginning of the second display frame, the second potential applied to the pixel electrode to the third potential;

apply, during the second display frame and while the third potential is applied to the common electrode, a fourth potential to the pixel electrode;

change, at a beginning of a third display frame subsequent to the second display frame, the third potential applied to the common electrode to the first potential; and change, at the beginning of the third display frame, the fourth potential applied to the pixel electrode to the first potential; and a projector lens to project the image light.

10. A system according to claim 9, wherein the one pixel imaging element is not reset to the reset state between the application of the second potential and the change of the second potential to the third potential.

* * * * *